United States Patent [19]

Kennedy

[11] 4,178,528

[45] Dec. 11, 1979

[54] IMAGE INTENSIFIER UNITUBE FOR INTENSIFIED CHARGE TRANSFER DEVICE AND METHOD OF MANUFACTURE

[75] Inventor: Andrew J. Kennedy, Lorton, Va.

[73] Assignee: The United States of America as represented by the Secretary of the Army, Washington, D.C.

[21] Appl. No.: 922,015

[22] Filed: Jul. 5, 1978

[51] Int. Cl.[2] ..... H01J 39/02; H01J 39/14

[52] U.S. Cl. ..... 313/102; 313/318; 316/22; 29/25.13

[58] Field of Search ..... 313/94, 101, 102; 250/213 VT

[56] References Cited

FOREIGN PATENT DOCUMENTS 1401434 7/1975 United Kingdom ..... 313/101

*Primary Examiner*—Robert Segal

*Attorney, Agent, or Firm*—Nathan Edelberg; Milton W. Lee; Max L. Harwell

[57] ABSTRACT

A unitube that is used in intensified charge transfer devices (ICTDs) having a semiconductor charge transfer device in proximity focus with the photocathode. The unitube is comprised of a tube base section having a centrally raised portion where the charge transfer device (CTD) is internally mounted directly thereon and of an external open space for the mounting of a thermoelectric (TE) cooler for cooling the semiconductor CTD.

The CTD has a grounded metal shield overlapping its outer portion to avoid high voltage break down in the area between the high voltage photocathode and the CTD. The base may be brazed to one end of the image intensifier tube wall by a Kovar ring. The faceplate may be attached to the other end of the image intensifier by a blunt or knife edge type indium seal.

13 Claims, 1 Drawing Figure

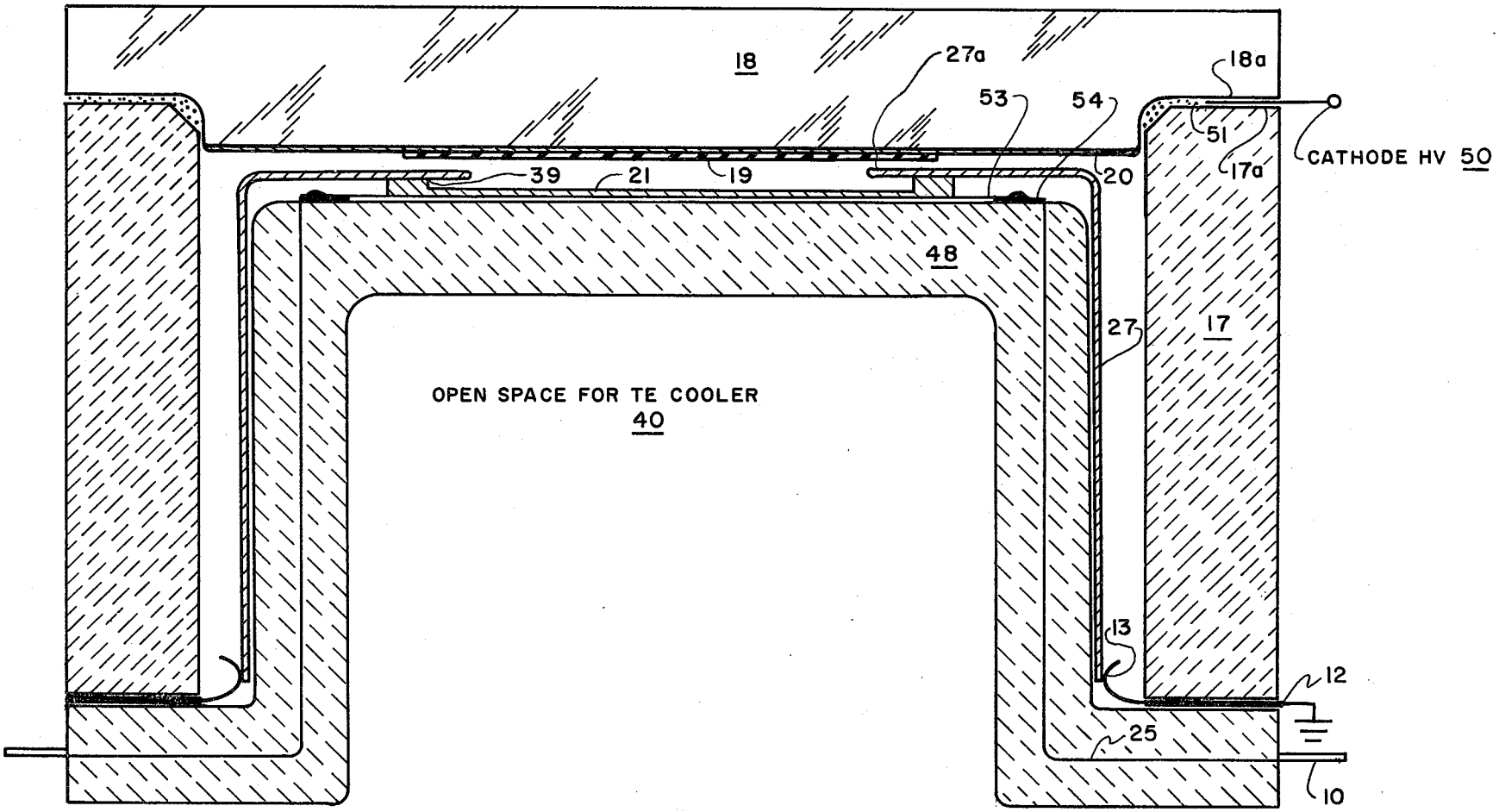
CATHODE HV 50
18a
51
17a
17
12
10
20
27
13
25
54
53
27a
48
18
19
21
39
OPEN SPACE FOR TE COOLER
40

IMAGE INTENSIFIER UNITUBE FOR INTENSIFIED CHARGE TRANSFER DEVICE AND METHOD OF MANUFACTURE

The invention described herein may be manufactured, used, and licensed by the U.S. Government for governmental purposes without the payment of any royalties thereon.

BACKGROUND OF THE INVENTION

The present invention is in the field of providing preshaped image intensifier tube components for improved image tube high voltage operation and in the method of manufacturing the present image intensifier unitube.

Unshielded flip chips have been proposed but they are not considered a viable approach to intensified charge coupled devices (ICCDs) or intensified charge injection devices (ICIDs) because the edges of the semiconductor flip chips are too rough and are exposed to greater than the operational voltages that cause in excess of $10^5$ volts per centimeter electric fields. With the unshielded flip chips, an electric field of this proportion virtually assures high voltage electric breakdown due to field emission. The present invention solves the problem of not having the rough edges on the flip chip CTD input side or having the rough perimeter, where the transition from the thick portion to the thin portion occurs, exposed to high electric fields. Further, it is comprised of a tube base comprised of a centrally raised portion that has the CTD mounted thereon after the tube base is brazed to the tube wall, rather than separately bonded thereto in a later heliarc welding step.

SUMMARY OF THE INVENTION

The present invention relates to improved image intensifier tubes and the method of manufacture and specifically an embodiment herein called a unitube, that is comprised of a CTD bonded to the interior of centrally raised portion of a tube base prior to the brazing step of the combined tube base and tube wall. Thus, the delicate CTD is not exposed to heliarc welding environment of prior art separate CTD bonding methods. The tube base, having a plurality of internal conductors therein, is first high temperature brazed by a Kovar ring to a cylindrical shaped tube wall. The second step is bonding the CTD and a plurality of beam leads on the interior of the centrally raised portion. Next, a ground metal shield is bonded to the inner centrally raised portion reaching from an extended lip portion over the CTD to the electrically grounded Kovar ring. The plurality of beam leads help hold the CTD in position and are electrically bonded to interior ends of said plurality of internal conductors.

The generally flat cathode faceplate with the photocathode thereon and the above combined tube base and tube wall are placed in separate sections inside an ultra high vacuum processing chamber, at about $10^{-11}$ Torr, that is designed for external cathode processing. The combined tube wall and tube base with CTD bonded thereon are baked for about 10 hours at 350° C. to 400° C. The upper limit of the temperature is determined by the stability of the CTD performance characteristics, but the temperature must be at least 350° C. to decontaminate the tube body sufficiently to maintain a stable, high sensitive photocathode. Further cleaning of the tube body may be accomplished by electron beam scrubbing. Beam current densities on the order of one nanoamp per square centimeter at a voltage of 8 to 10 kilovolts for 1 to 2 hours should be sufficient. It has been demonstrated that higher current densities can cause irreversible x-ray damage in the CTD.

In a separate location of the ultra high vacuum process chamber, the cathode faceplate may be heated on a metal pedestal to about 630° C. to 660° C. for a period of less than one minute. These temperature limits are just below the decomposition temperature for the Group III–V photocathode materials that are preferably used. The purpose of the heating step for the faceplate is to create an ultra clean surface on the cathode semiconductor prior to activation with cesium and oxygen at room temperature. Cesium and oxygen are alternately applied to the clean cathode surface and are repeated several times while the relative photoemissive yield is monitored by the quantum efficiency of photoemission until the maximum photoemission yield is achieved.

Cesium is applied to the tube wall and tube base to condition the interior and to compensate for the cesium loss from the photocathode during the transfer of the cathode faceplate from the metal pedestal for mating with the tube wall. The faceplate and tube wall are mated by a seal, such as a blunt or knife edge type indium seal. Once the mating blunt or knife edges of the faceplate and the tube wall are accurately positioned over the indium sealing edge, a pressure of 150 to 200 pounds per square inch for up to an hour is applied thereto to produce an ultra high vacuum indium seal at a temperature of about 22° C. to 23° C.

The finished image intensifier unitube is now potted on the side with a silicone rubber insulator, such as General Electric RTV–11, to prevent high voltage breakdown along the outside of the unitube. An external high voltage source is applied to the photocathode to slowly raise the operating voltage in order to "condition" the interior of the unitube by burning out minor leakage paths and field emission points. The intensified image intensifier unitube is then ready for test and evaluation.

IN THE DRAWINGS

The lone FIGURE illustrates the embodiment of the present image intensifier unitube.

DETAILED DESCRIPTION OF THE UNITUBE EMBODIMENT

Look now at the lone FIGURE for explanation of the present image intensifier unitube. Numeral 48 represents the ceramic tube base. Base 48 is high temperature brazed to a ceramic cylindrical tube wall 17 by a Kovar ring 12. The Kovar ring 12, which may be about 10 mils thick, is brazed to metallized layers on both tube base 48 and tube wall 17. Numeral 18 represents the cathode faceplate that has a photocathode layer 19 and metal layer 20 deposited thereon. Layer 20 provides high voltage electrical contact for the photocathode. The faceplate 18 is preferably made of glass and the photocathode 19 material comes from the Group III–V materials, such as gallium-arsenide, wherein the Group III–V photocathode material is epitaxially grown and thermally bonded into the faceplate 18. The finished unitube has a seal, such as a blunt or knife edge type indium seal 51, between the tube wall 17 and the cathode faceplate 18. A cathode high voltage source connection 50 is embedded in the cold indium ultra high vacuum seal between the faceplate sealing edge 18a and tube wall sealing edge 17a. The conductive indium is in electrical contact with metal layer 20.

The unique unitube has a base 48 that is configured with an inner centrally raised portion upon which the silicon base chip CTD 21 is mounted an an open space 40 for a thermoelectric cooler. Base 48 has a plurality of internal conductors 25 built therein. Conductors 25 extend from a plurality of mounting pads 54 on the interior of the raised portion to a plurality of external pins 10 for connection to external electronics. The CTD 21 has a plurality of beam leads 53 bonded thereto that are connected to said plurality of mounting pads. The beam leads may be made of gold, or gold coated nickel or aluminum, which may be about 12 micrometers thick and 125–150 micrometers wide. A metal shield 27 is placed over the unitube base 48. Metal shield 27 has a smooth well rounded extended lip 27a that extends over the thick outer portion of the CTD at one end and is conductively connected to a spring loaded electrical contact 13 on the inside of the tube wall 17 at the other end. Metal shield 27 is in electrical contact with the thick portion of the CTD 21 at area represented by numeral 39. The thick portion of CTD 21 may be about 100 micrometers and the thin portion may be about 10 micrometers. The electrical contact 13 is formed as a part of the Kovar ring 12 and is grounded to metal shield 27 to bleed off stray current from the photocathode 19 and backscatter electrons from the CTD 21.

Although only one embodiment of the invention has been illustrated and described, various changes may be made by one skilled in the art without departing from the scope of the invention.

I claim:

1. A method of manufacturing an image intensifier unitube for intensified charge transfer device, the steps comprising:

providing a ceramic tube base having a plurality of internal conductors built therein electrically connected between a plurality of external pins and a plurality of mounting pads mounted on an inner centrally raised portion thereof;

providing a generally cylindrical ceramic tube wall;

brazing said tube base to said tube wall by a circular Kovar ring wherein said Kovar ring has an inner spring loaded contact;

bonding a charge transfer device and a plurality of beam leads therefrom on said inner centrally raised portion, said plurality of beam leads being electrically connected to said plurality of mounting pads;

placing a metal shield over a thick outer portion of said charge transfer device and along the inside walls of said inner centrally raised portion;

placing a generally flat cathode faceplate with photocathode layer and metallized layer thereon and said ceramic tube base and ceramic tube wall in separate sections inside an ultra high vacuum processing chamber;

baking said combined tube wall and tube base with CTD mounted thereon at an upper limit temperature determined by the stability of the CTD performance characteristics to decontaminate the tube body;

heating said cathode faceplate and photocathode while mounted on a metal pedestal to just below the decomposition temperature for the photocathode materials to create an ultra clean surface on the photocathode semiconductor;

activating said photocathode with alternate applications of cesium and oxide at room temperature while monitoring the photoemissive yield;

applying cesium to the tube body to condition said tube body interior and to compensate for the cesium loss during a subsequent step of transferring said cathode faceplate and photocathode from the metal pedestal to mate with the tube body;

positioning and sealing said generally flat cathode faceplate by sealing edges on said tube wall and said faceplate to vacuum seal the interior of said unitube body and to place said photocathode in proximity focus with said charge transfer device;

potting the outside of said tube wall with a silicon rubber insulator to prevent high voltage breakdown along the outside of said unitube body; and slowly applying a cathode high voltage to said photocathode to condition the interior of said unitube.

2. A method as set forth in claim 1 wherein in said step of bonding a charge transfer device and a plurality of beam leads is comprised of a charge transfer device having a thick outer portion of about 100 micrometers thick and an inner portion about 10 micrometers thick and said beam leads are about 12 micrometers thick and 125 to 150 micrometers wide.

3. A method as set forth in claim 2 wherein said plurality of beam leads are made of gold.

4. A method as set forth in claim 2 wherein said plurality of beam leads are made of gold coated nickel.

5. A method as set forth in claim 2 wherein said plurality of beam leads are made of gold coated aluminum.

6. A method as set forth in claim 5 wherein in the step of placing said faceplate and said tube base and tube wall inside an ultra high vacuum processing chamber the chamber is at about $10^{-11}$ Torr pressure.

7. A method as set forth in claim 6 wherein the step of baking said combined tube wall and tube base at an upper limit temperature is at a temperature of from 350° C. to 400° C. for 10 hours.

8. A method as set forth in claim 7 wherein the step of heating said cathode faceplate and photocathode is at 630° C. to 660° C. for a period of less than one minute.

9. A method as set forth in claim 8 wherein said cathode faceplate is glass and said photocathode comes from the Group III–V elements.

10. A method as set forth in claim 9 wherein said Group III–V elements are gallium arsenide.

11. A method as set forth in claim 1 wherein in the step of positioning and sealing is by a blunt edge type indium sealing edges at room temperature.

12. A method as set forth in claim 1 wherein in the step of positioning and sealing is by knife edge type indium sealing edges at room temperature.

13. In an image intensifier tube, a unitube device for intensified charge transfer device having said charge transfer device in proximity focus with the photocathode, the unitube device comprising:

a ceramic tube base having a cupped shaped inner centrally raised portion and an outer open space, said ceramic tube base having a plurality of internal conductors built therein extending from a plurality of mounting pads on the inner centrally raised portion to a plurality of external pins, said ceramic tube base further comprised of a charge transfer device having a plurality of beam leads therefrom whose ends are in electrical contact with said plurality of mounting pads and a metal shield placed over the inner area of said centrally raised portion extending from a smooth well rounded extended lip over the outer thick portion of said charge transfer device down the inside walls of said ceramic tube base;

a generally cylindrical tube wall high temperature brazed to said ceramic tube base by a Kovar ring wherein said Kovar ring has an inner spring loaded electrical contact that is in electrical contact with said metal shield; and a cathode faceplate having a photocathode thereon in proximity focus with said charge transfer device, and cathode faceplate positioned with and vacuum sealed against said tube wall by a blunt edge type indium seal.

* * * * *